US009109776B2

(12) United States Patent
Smith

(10) Patent No.: US 9,109,776 B2
(45) Date of Patent: Aug. 18, 2015

(54) SEGMENTED LED LIGHTING SYSTEM

(71) Applicant: Gregory S. Smith, Santa Ana, CA (US)

(72) Inventor: Gregory S. Smith, Santa Ana, CA (US)

( * ) Notice: Subject to any disclaimer, the term of this patent is extended or adjusted under 35 U.S.C. 154(b) by 189 days.

(21) Appl. No.: 13/573,810

(22) Filed: Oct. 5, 2012

(65) Prior Publication Data

US 2014/0098535 A1 Apr. 10, 2014

(51) Int. Cl.

| | |
|---|---|
| ***F21V 5/04*** | (2006.01) |
| ***F21S 4/00*** | (2006.01) |
| *F21Y 101/02* | (2006.01) |

(52) U.S. Cl.

CPC . *F21V 5/04* (2013.01); *F21S 4/006* (2013.01); *F21S 4/008* (2013.01); *F21Y 2101/02* (2013.01)

(58) Field of Classification Search

None

See application file for complete search history.

(56) References Cited

U.S. PATENT DOCUMENTS

| | | | | |
|---|---|---|---|---|
| 6,592,238 | B2 | 7/2003 | Cleaver et al. | |
| 6,761,472 | B1 | 7/2004 | Cleaver et al. | |
| 6,953,262 | B2 | 10/2005 | Cleaver et al. | |
| 7,188,970 | B2 | 3/2007 | Cleaver et al. | |
| 2004/0141760 | A1 * | 7/2004 | Wynne Willson | 398/197 |
| 2005/0190552 | A1 * | 9/2005 | Sloan et al. | 362/219 |
| 2006/0133076 | A1 * | 6/2006 | Sloan et al. | 362/216 |
| 2007/0291473 | A1 * | 12/2007 | Traynor | 362/106 |
| 2009/0261706 | A1 * | 10/2009 | Sorella et al. | 313/46 |
| 2010/0253226 | A1 * | 10/2010 | Oki | 315/113 |
| 2012/0002417 | A1 * | 1/2012 | Li | 362/249.02 |
| 2013/0050998 | A1 * | 2/2013 | Chu et al. | 362/218 |
| 2013/0107514 | A1 * | 5/2013 | McNabb et al. | 362/231 |

OTHER PUBLICATIONS

No author, excerpt from 2000 Neo-Neon catalog—Duralight (1999).

* cited by examiner

*Primary Examiner* — Ashok Patel

(74) *Attorney, Agent, or Firm* — Gray Law Firm; Gordon E. Gray, III

(57) ABSTRACT

The present invention is a segmented LED lighting system. In particular, the present invention is directed to a set of channel segments connected by a flexible lens sleeve that can be positioned in a variety of ways. A printed circuit board with at least one LED is mounted in each channel segment. Each segment preferably has a base with two ribbed vertical sides. The lens sleeve is preferably coextruded from flexible acrylic and has opaque side grips that grip the ribbed vertical sides and a translucent lens portion with an air gap. Pairs of encapsulated PCB modules are preferably connected in series to allow the system to be cut in the field.

2 Claims, 6 Drawing Sheets

SEGMENTED LED LIGHTING SYSTEM

TECHNICAL FIELD

The present invention is a segmented LED lighting system. In particular, the present invention is directed to a set of channel segments connected by a flexible lens sleeve that can be positioned in a variety of ways.

BACKGROUND ART

The use of light fixtures with light emitting diodes (LEDs) to replace neon fixtures for, among other things, signage and accent lighting usage is known in the prior art, e.g. U.S. Pat. Nos. 6,592,238; 6,761,472; 6,953,262; and 7,188,970. However, the use of LEDs can have a variety of drawbacks. For example, some prior art LED lighting systems are difficult to shape or position in the field such as lettering or designs for a sign or building. Furthermore, prior art LED lighting systems often cannot be cut to size in the field.

SUMMARY OF THE INVENTION

The present invention is a segmented LED lighting system. In particular, the present invention is directed to a set of channel segments connected by a flexible lens sleeve that can be positioned in a variety of ways. A printed circuit board with at least one LED is mounted in each channel segment. Each segment preferably has a base with two ribbed vertical sides. The lens sleeve is preferably coextruded from flexible acrylic and has opaque side grips that grip the ribbed vertical sides and a translucent lens portion with an air gap. Pairs of encapsulated PCB modules are preferably connected in series to allow the system to be cut in the field.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figures 1, 1A:
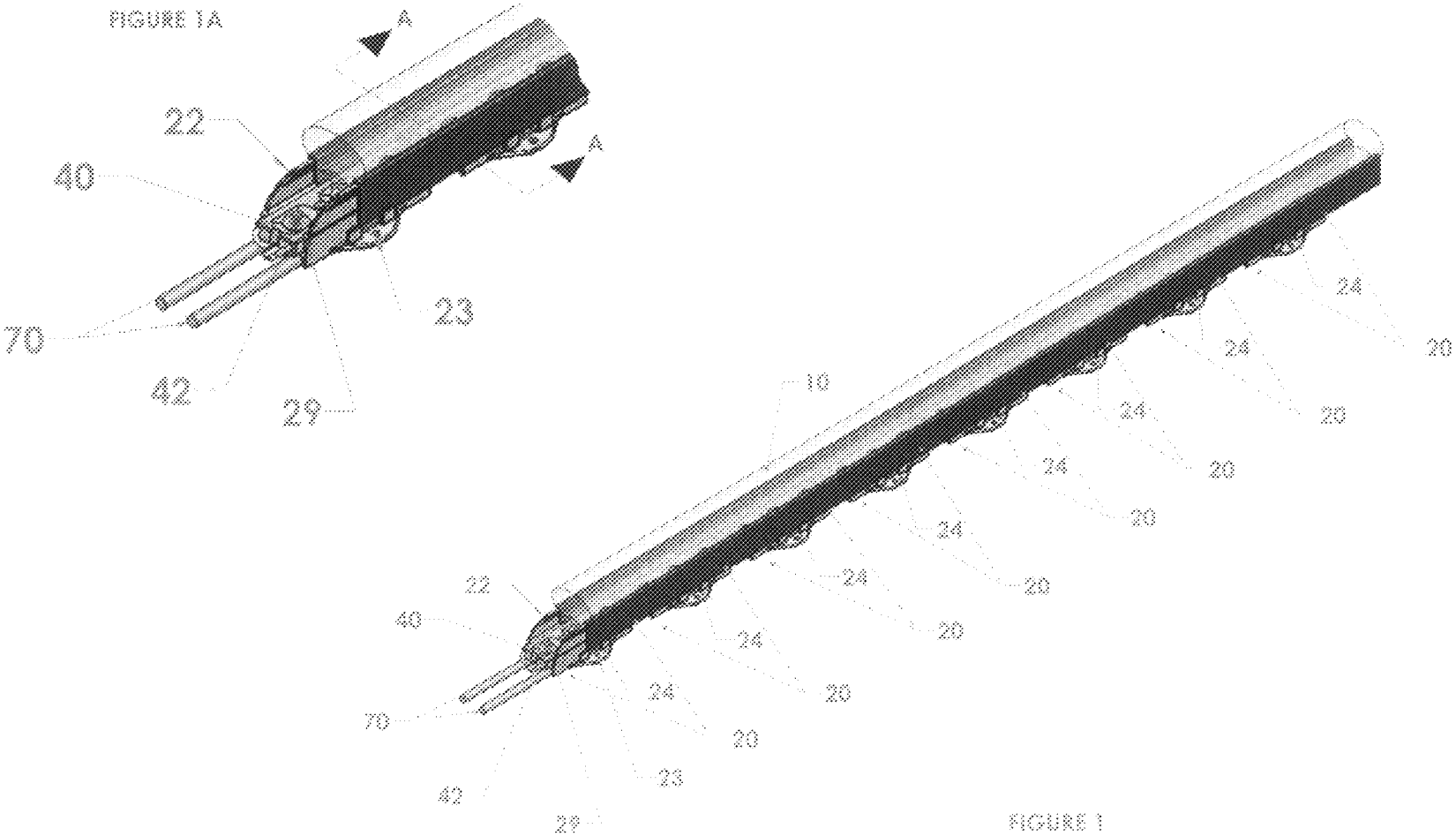
FIG. 1 is a perspective side view of a length of a preferred embodiment of the invention.
FIG. 1A is close up view of the left end of FIG. 1.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s). The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide segmented LED lighting.

Figure 6:
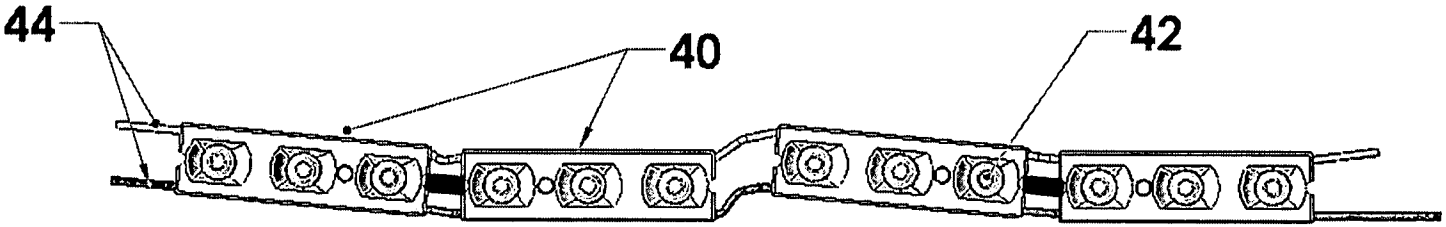

Referring now to FIG. 1, a perspective view of a length of a preferred embodiment of the invention 10 is shown. The lighting system 10 shown is segmented having a number of channel segments 20. The channel segments are preferably made of polyvinyl chloride (PVC) but can be made of other materials such as aluminum. Each channel segment 20 preferably has two vertical sides 22 that extend from a base 24 with rounded corners 29. The rounded corners 29 allow the segments 20 to more easily be positioned to form curves and/or arcs. Preferably, the base 24 of each segment 20 has at least one hole 23 to permit the base 24 to be nailed or screwed down. The channel segments 20 are connected to form the length 10 by a flexible lens sleeve 30 fitted onto the vertical sides 22 of each segment 20. Preferably, two flexible tubes 70 are made of polyvinyl chloride are mounted along the bases 24 of the segments 20 and join the segments 20 into a length 10. The tubes 70 can be flexible wires, cords or other flexible lengths. Alternately, the tubes 70 can be power leads for powering the encapsulated PCBs 40. Also mounted in the segments 20 are encapsulated printed circuit boards (PCBs) 40 with at least one LED 42 mounted thereon (preferably three LEDs). The preferred encapsulated PCBs 40 are manufactured by Foshan Nationstar and disclosed in U.S. Pat. Appl. 2012/0002407, which is incorporated herein by reference. A preferred embodiment of two pairs of encapsulated PCBs 40 with three LEDs is shown in FIG. 6 (the pairs are connected by a third wire). Alternately, standard printed circuit boards (PCBs) can be used.

Referring now to FIG. 1A, a close up view of the left end of FIG. 1 is shown. In particular, the rounded corners 29 of the vertical sides 22 of channel segment 20 are shown. The cross-sectional view along line A-A is shown in FIG. 4 as opposed to FIG. 2, which shows an end view of a channel segment 20 without a flexible lens sleeve 30 or tubes 70 or PCB 40.

Figures 2, 3:
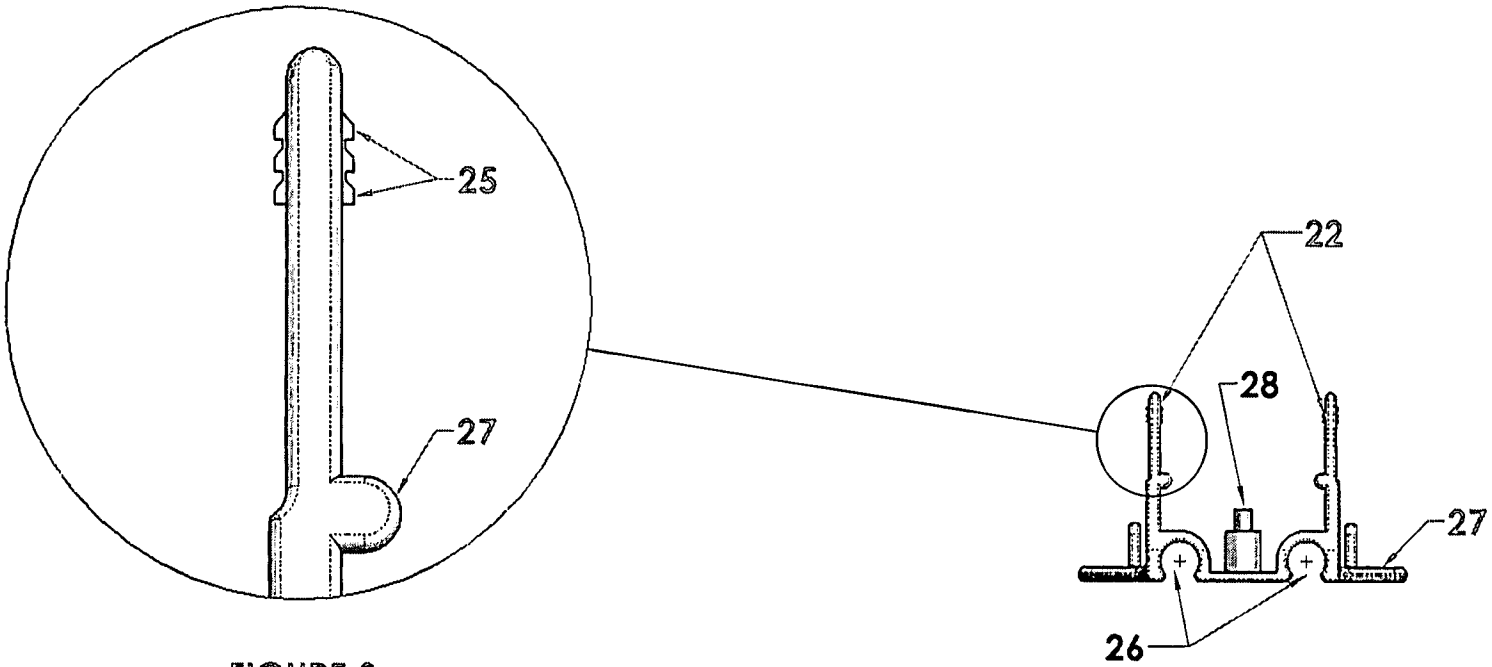
FIG. 2 is an end view of a preferred embodiment of a channel segment.
FIG. 3 is an end view of a preferred embodiment of a vertical side of a channel segment.

Referring now to FIG. 2, an end view of a preferred embodiment of a channel segment 20 is shown. As shown, the base 24 preferably has two sub-channels 26 for the tubes 70. Two vertical sides 22 extend upward from the base 24. Referring now to FIG. 3, a close up side view of a preferred embodiment of a vertical side 22 is shown. As shown, the vertical side 22 is preferably ribbed 25 to increase frictional contact with the flexible lens sleeve 30. The vertical sides 22 also preferably have protrusions 27 on an interior surface of the side 22 to contain the encapsulated PCB 40 on the mounting post 28. Returning to FIG. 2, the preferred embodiment of the segment 20 also has a mounting post 28 on which the encapsulated PCB 40 is preferably mounted. The mounting post 28 preferably has a threaded hole for a mounting screw (not shown).

Figure 4:
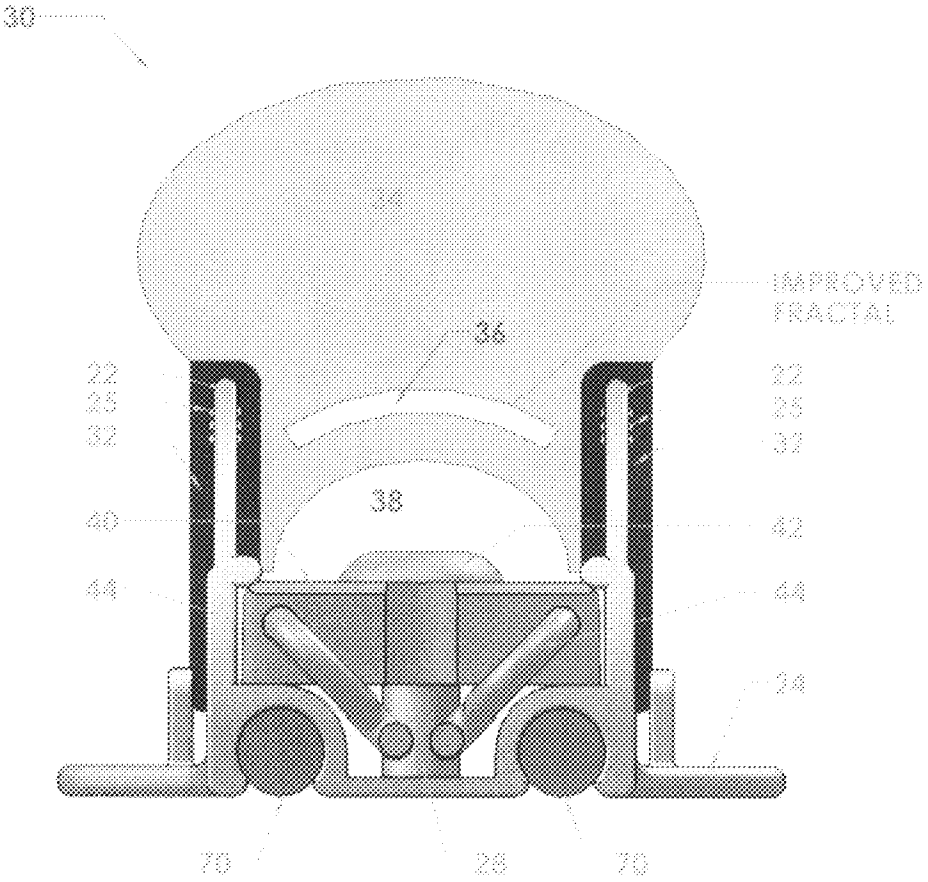
FIG. 4 is a cross-sectional view along line A-A of FIG. 1A.

Referring now to FIG. 4, an end view of the preferred embodiment of the invention 10 is shown. The flexible lens sleeve 30 is preferably made of flexible acrylic and made by co-extrusion of at least two different colors and optical properties. The preferred type of flexible acrylic is KURARITY LA 4285. Alternately, the sleeve 30 can be made of other flexible material such as polyvinyl chloride (PVC). However, flexible acrylic is generally more resistant to the elements in outdoor installations. Preferably, the sleeve 30 has opaque side grips 32 that grip the channel segment's vertical sides 22 with ribs 25. The side grips 32 are preferably opaque, e.g. black or dark gray, both inside and outside the channel segment 20. The lens portion 34 of the sleeve 30 is preferably transparent or translucent to allow light to pass from the LED 42 and out of the sleeve 30 and channel 20. By using a translucent lens portion 34, the lens sleeve 30 can appear to be a solid band of light, similar to neon tubing, and not merely a series of point light sources. The lens portion 34 also preferably has an air gap 36 to help proper diffraction of the light along the length and width of the lens sleeve 30. The area 38 between the PCB 40 and the lens sleeve 30 is preferably an air gap 38 as well. This air gap 38 also aids in increasing light diffusion.

Pairs of channel segments 20, each with an encapsulated PCB 40 and at least one LED 42, are preferably connected in series by leads 44. By only having pairs of segments 20 connected in series, the segmented length 10 can be more easily cut in the field at one pair intervals to fit different lighting configurations and shapes and to permit easier replacement of boards 40. Preferably, there is slack in the leads 44 between pairs for easier removal and replacement of boards 40.

Figure 5:
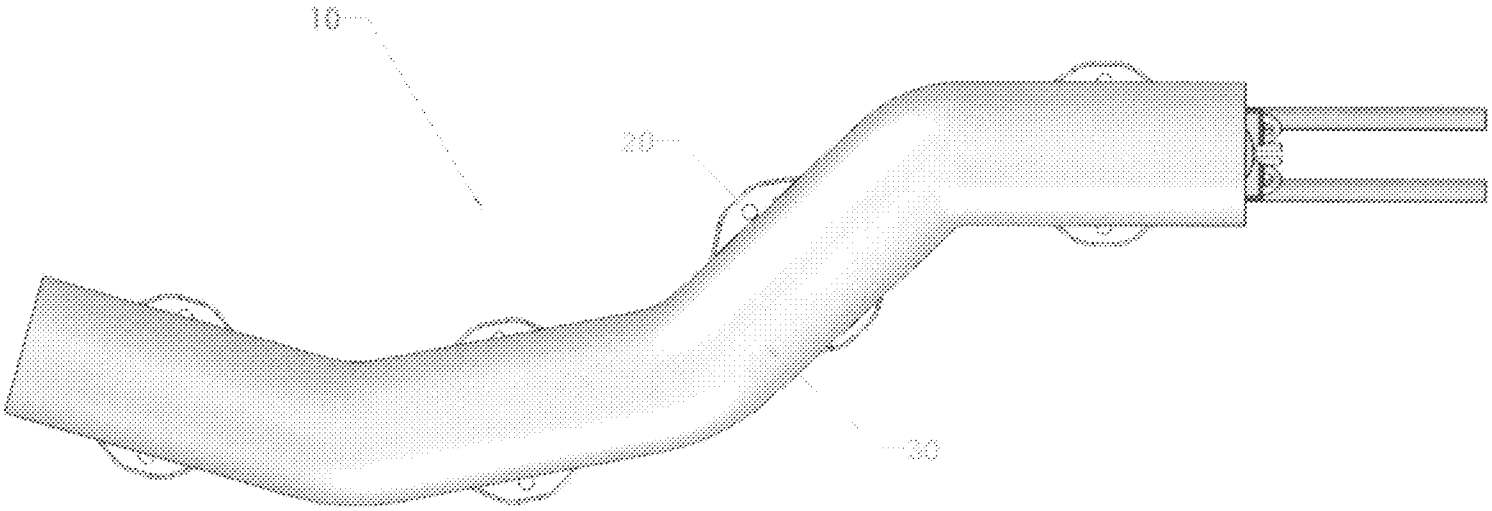
FIG. 5 is a top view of a length of a preferred embodiment of the invention in a serpentine configuration; and, FIG. 6 is a top view of two pairs of encapsulated PCB modules, each with three LEDs.

Referring now to FIG. 5, a top view of a length of a preferred embodiment of the invention 10 in a serpentine configuration is shown. The sleeve 30 and the tubes 70 are flexible so the fixture 10 can be manipulated to position the channel segments 20 into a variety of shapes and positions. Accordingly, the segmented lighting system 10 can be manipulated in the field into a variety of ways, e.g. shapes, letters and designs.

Figure 7:
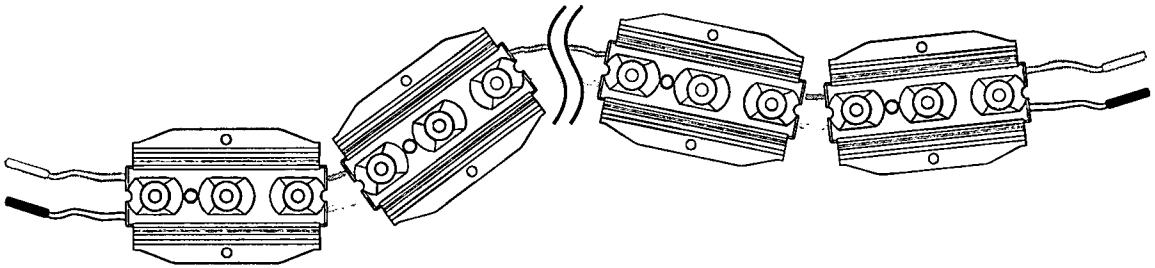
FIG. 7 is a top view of a preferred embodiment of a plurality of channel segments without a flexible lens sleeve.

Referring now to FIG. 6, two pairs of PCBs 40 are shown with LEDs 42 and connected by leads 44. The PCBs 40 are not shown mounted to channel segments 20. Referring now to FIG. 7, two pairs of channel segments are shown with PCBs and LEDs mounted thereon. However, for clarity, the flexible lens sleeve (shown in FIG. 5) has been removed from view.

Thus, a segmented LED lighting system is described above that can be shaped or positioned in the field in a variety of ways such as lettering or designs for a sign or building. The system is also preferably cuttable in the field. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

Various modifications and alterations of the invention will become apparent to those skilled in the art without departing from the spirit and scope of the invention, which is defined by the accompanying claims. It should be noted that steps recited in any method claims below do not necessarily need to be performed in the order that they are recited. Those of ordinary skill in the art will recognize variations in performing the steps from the order in which they are recited. In addition, the lack of mention or discussion of a feature, step, or component provides the basis for claims where the absent feature or component is excluded by way of a proviso or similar claim language.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration. The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A segmented LED lighting system comprising:

a plurality of polyvinyl chloride channel segments, each channel segment having a base with sub-channels, a mounting post and two ribbed vertical sides, where the plurality of channel segments forms a length connected by a flexible acrylic lens sleeve containing an air gap fitted along the length of channel segments on the vertical sides;

wherein at least one LED is mounted on an encapsulated printed circuit board mounted on the mounting post at the base of each channel segment; and, a pair of flexible tubes running along and joining the base of each channel segment, where each sub-channel holds one of the flexible tubes.

2. The segmented LED lighting system of claim 1 where the base of each channel segment has rounded corners for re-positioning of the length of channel segments.

* * * * *